United States Patent [19]

Kovaleski

[11] 4,298,174

[45] Nov. 3, 1981

[54] WIRE TAKE-OFF DEVICE

[75] Inventor: Joseph J. Kovaleski, Easton, Conn.

[73] Assignee: Wyrepak Industries, Inc., Bridgeport, Conn.

[21] Appl. No.: 151,943

[22] Filed: May 21, 1980

[51] Int. Cl.[3] ..... B65H 49/00

[52] U.S. Cl. ..... 242/128

[58] Field of Search ..... 242/54 R, 128, 130, 242/131, 157 R; 57/58.86

[56] References Cited

U.S. PATENT DOCUMENTS

| | | | |
|---|---|---|---|
| 2,935,274 | 5/1960 | Pearson | 242/128 |
| 2,942,802 | 6/1960 | Bachus | 242/128 |
| 3,150,845 | 9/1964 | Pool | 242/131 |

*Primary Examiner*—Leonard D. Christian
*Attorney, Agent, or Firm*—H. Gibner Lehmann; K. Gibner Lehmann

[57] ABSTRACT

A wire de-reeling apparatus for transferring wire from one or more spools and with a minimum of excessive looseness or kinking, the apparatus comprising a support for mounting the spool with one spool end free, a rotatable take-off wheel located at the free spool end and being generally coaxial with the spool, and a rotatable tension brush also disposed at the spool end and having a plurality of radially disposed, flexible wire-restraining tines. The wheel is rotatable under the action of a strand of wire being payed off the spool. The brush is mounted on a central hub which is at or near the spool axis, and the tines extend radially a short distance past the circumferential edge of the wheel, to be brushed by the strand of wire as it is being de-reeled. In addition, a power drive arrangement is linked to the hub, whereby the brush can be rotatably driven in the same direction as that traveled by the strand as it unwinds, thereby reducing the relative circumferential speed of the strand with respect to the periphery of the rotating brush, resulting in significantly reduced drag forces applied to the strand and lessening the likelihood of breakage under conditions of high take-off speed.

Also a de-reeling apparatus for accommodating two separate spools, the spools being adapted to hold a single, continuous strand of wire. The apparatus enables a high-speed take-off to be obtained, with automatic means which permit take-off to commence from the second spool as soon as the first spool is emptied.

31 Claims, 15 Drawing Figures

192
190
196
199
201
198
210
206
188
214
194
216
212
200
208
218
202
120
108
118
124
114
56
6
130
152
160
148
140
54
164
170
132
168
158
134
172
176
136
146
138
142
162
166
174
156
154
150
92
5
108
104
94
114
88
116
28
106
110
122
112
4

76
100
98
82
84
86

230
60
8
250
244
20
251
242
30
78
252
254
228
40
32
22
42
24
13

338
316
313
66
348
342
312
306
308
344
346
340

WIRE TAKE-OFF DEVICE

BACKGROUND

This invention relates generally to systems for de-reeling wire from wire-filled spools, and more particularly to arrangements which permit high-speed de-reeling to be achieved.

Applicant's U.S. Pat. No. 3,425,647 dated Feb. 4, 1969 discloses one such wire pay-off arrangement for a spool. In this patented device, wire from the spool was adapted to be payed off one free end, with the spool being held stationary. In order to reduce the tendency for the wire to wear against the flange, there was provided a freely-rotatable wheel or cap at the free end of the spool, having a curved peripheral rim which extended beyond the spool end flange and prevented the unraveling strand from directly contacting the same. The wheel, being essentially free, was capable of rotating at a speed which was commensurate with the speed at which the strand traveled around the periphery of the spool flange. Naturally, as the take-off speed increased, the wheel speed also increased as a result of its frictional engagement with the strand.

In addition, the patented device incorporated a circular brush having radial tines, the tines being stationary and extending a short distance past the peripheral portion of the wheel. As the strand of wire traveled, it brushed by the tines, one or several at a time. With the disclosed arrangement, the number of tines was sufficiently small so that any drag force imparted to the traveling strand was small, particularly at low-take-off speeds. In the event that pay-off was suddenly stopped, the engagement of the strand and the tines prevented undesirable looseness of the wire by inhibiting continued unraveling of those turns of wire remaining on the spool.

While the above arrangement was satisfactory for many installations, several problems appeared when it was desired to increase the speed at which wire was payed off the spool. In particular, with high pay-off speeds, the relatively few numbers of separate tines was, in some cases, insufficient to halt the wire promptly in the event that the take-off speed was suddenly reduced. Increasing the number of tines over that shown in the patented device had a desired effect of increasing the drag force on the individual strand, but created other problems when it was desired to employ such high-speed de-reeling equipment. Where the wire gauge was relatively small, high take-off speeds resulted in considerable drag forces, these sometimes being sufficient to cause breakage of the strand. In applications where the take-off speed approached thousands of feet per minute, sudden breakage of the wire strand caused great problems, with significant accumulation of unraveling turns and the resulting looseness, kinking, etc., which tended to make the entire operation overly complex. The resulting down-time, as well as the loss represented by broken strands, proved unacceptable for many installations. In certain cases, broken strands could be repaired by splicing but in other cases, a broken strand might result in scrapping an entire reel, especially where a splice-free, single length (continuous) of wire was required.

Other efforts involved controlling the speed of the take-off wheel in order to minimize the tendency of the same to continue unraveling wire after the take-up speed was suddenly halted. One solution to this problem was disclosed in applicant's U.S. Pat. No. 3,972,489 dated Aug. 3, 1976. The patented device involved a take-off mechanism incorporating a stationary tension brush, and a rotatable wheel as in the previous patent, with the exception that an adjustable brake mechanism was provided on the wheel such that a consistent drag force opposing the free rotation of the wheel was applied thereto. The magnitude of the force imparted by the brake was set manually by the operator, to suit the particular conditions as dictated by the type of wire being de-reeled, the gauge, take-off speed, etc. This particular arrangement solved a number of problems which were inherent in prior de-reeling mechanisms.

In spite of the advances provided by the two patented devices mentioned above, as well as other new arrangements which have been devised by others and which constitute the prior art as of the present time, problems still remained when it was attempted to achieve high-speed operation involving pay-out of wire from the free end of a spool, where relatively fine, fragile wire was being transferred and where the tensile strength of the wire was not sufficiently high. Fine-gauge copper wire is an example of one of the items which has been found to cause great difficulty. The drag effect of multiple tines which were brushed by the traveling strand often proved to be too great, resulting in breakage. This had the undesirable consequences noted above, resulting in excessive downtime, waste of product, the need for splicing, etc.

Prior fixtures of the type which carried multiple spools and which were intended to permit de-reeling from a series of such spools have been devised. They all suffered from the inability to quickly shift the de-reeling operation to a full spool once a partially filled unit was emptied. Some arrangements required a complete halting of the pay-off operation while the transfer was manually effected. This resulted in unnecessary and costly downtime, with its consequent bother and expense.

SUMMARY

The above disadvantages and drawbacks of prior wire de-reeling systems are largely obviated by the present invention which has for an an object the provision of a novel and improved wire-take-off device which is simple in construction, reliable in operation, and highly resistant to malfunction or failure.

Another object of the invention is the provision of a take-off apparatus as above, wherein a wide range of wire sizes can be accommodated, and wherein the likelihood of breakage of the smaller gauge types is greatly minimized.

Still another object of the invention is the provision of a high-speed wire take-off apparatus which can be incorporated as a component of a larger wire-processing system which is essentially fully automated, so as to reduce the need for constant attention by an operator, and thereby minimize the overall manufacturing cost or processing expense.

Yet another object of the invention is the provision of a pay-off apparatus for effecting continuous pay-out of wire in the form of a single continuous strand that is carried on two separate spools, without the need for shutting down the equipment during the transition from the first spool to a second, after depletion of the first occurs.

Still another object is the provision of a dual-spool, take-off system wherein automatic means are provided to minimize the likelihood of breakage of the strand during the transition from one spool to the second.

Yet another object if the provision of a wire de-reeling apparatus incorporating relatively simple spool support means which are capable of undergoing swinging movement to thereby facilitate loading of full spools on the apparatus, and the unloading of empty spools therefrom, and which further permit exact positioning of each spool such that their axes can be made to converge toward a desired guide area of the apparatus.

A still further object is the provision of a wire-transfer apparatus of the type incorporating a circular tension brush, wherein automatic control means are provided for sensing or regulating the linear speed of the strand being de-reeled, and for adjusting the rate of rotation of the tension brush in a predetermined manner which is dependent upon the amplitude of the said linear speed.

Another object is the provision of a high-speed wire de-reeling apparatus incorporating automatic means for monitoring the tension in the strand being de-reeled, and for automatically shutting down the apparatus in response to loss of the tension in the strand as occasioned by inadvertent breakage thereof.

The above objects are accomplished by the provision of a take-off device for use in de-reeling wire from a spool without excessive looseness or kinking, comprising a support for fixedly mounting the spool with one end free, a freely-mounted, take-off wheel, generally coaxial with the spool and extending radially at least to the rim portion of the one spool end, to be engaged and rotated by wire which is unreeled in a predetermined direction from the spool and past the end thereof, and a rotatable hub disposed at the free end of the spool, and adjacent the axis of the wheel. The hub carries a plurality of substantially radially disposed flexible and slender, spoke-like wire-restraining tines which extend past the periphery of the wheel, with the outer end portions of the tines yielding to and being shifted peripherally by the unreeling wire, such that the wire is restrained from wholly free travel around the periphery of the spool end, and is prevented from freely unwinding around the end and kinking during slow wire take-off speeds or halting of the wire. In addition, powered means are provided, connected with the hub for rotatably driving the same in the said predetermined direction, and at a rate which is less than the speed at which the wire traverses the periphery of said one spool end, during relatively faster wire take-off speeds. The arrangement is such that the rate at which the wire brushes past the tines is maintained at a fairly low value, thus minimizing the drag effect of the tines on the wire, and reducing the possibility of inadvertent breakage of the strand.

The above objects are further accomplished by an apparatus for de-reeling wire from multiple wire-carrying spools in succession and without interruption, comprising a pair of spools, means for supporting the spools with one end of each spool free and with the axis of each spool generally converging toward a guide area, a wire guide disposed at the guide area, and means mounting the guide for swiveling movement about an axis which is askew with respect to those of the two spools. The arrangement is such that the guide can swing between a first position facing the free end of one of the spools, and a second position facing the free end of the other of said spools, as one spool becomes depleted and de-reeling from the other spool commences. The swiveling can be made to occur at precisely the proper instant to insure that the guide always faces that one of the spools from which pay-out is being effected, thus insuring smooth transfer operation and minimizing the possibility of breakage of the strand.

The above objects are also accomplished by the provision of a high-speed wire-transfer apparatus, comprising a spool, a support fixedly mounting the spool with one end free, a wire take-up mechanism to accept a strand of wire being de-reeled from the spool and having powered means for advancing the strand along its path of travel, a rotatable take-off wheel located at the free end of the spool, and a rotatable tension brush at the free end of the spool and having a plurality of substantially radially disposed, flexible and slender, spoke-like wire-restraining tines extending past the periphery of the wheel. In addition, powered means are provided for effecting rotation of the tension brush, and control means are connected with the powered means for the take-up mechanism and with the powered means for the tension brush, for regulating the rate of rotation of the tension brush as a function of the speed of travel of the strand that is being advanced. The arrangement is such that the rotation of the brush can be made to slightly lag the traversal of the wire strand around the spool flange periphery, at practically all wire speeds, thereby providing an optimum, controlled drag on the strand without the possibility of the strand breaking due to excessive drag forces thereon.

The foregoing objects are further accomplished by the provision of a take-off device comprising a metal framework having a pair of spaced, upstanding slides, and a guide area through which the strand of wire being de-reeled can pass, a pair of swivel carriers adjustably movable on the slides, respectively, and spool support members carried respectively by the carriers, and having means adapted to engage the respective spools for holding the latter, with one end of each spool free. The swivel carriers enable each of the spool support members to be swung to a first position permitting quick access to the same in order to facilitate the loading of full spools thereon, and the unloading of empty spools therefrom, and a second position wherein the axes of the spools are generally convergent toward the said guide area, to permit pay-off to occur first off the free end of the one spool until it becomes depleted, and then off the free end of the other spool, substantially without interruption in the speed of the strand through the guide area. As a result, the loading of heavy, filled spools is greatly facilitated, as is the precise positioning of the axes of the filled spools such that they converge toward the said desired guide area.

Other features and advantages will hereinafter appear.

In the drawings, illustrating a preferred embodiment of the invention:

Figures 1, 9, 10:
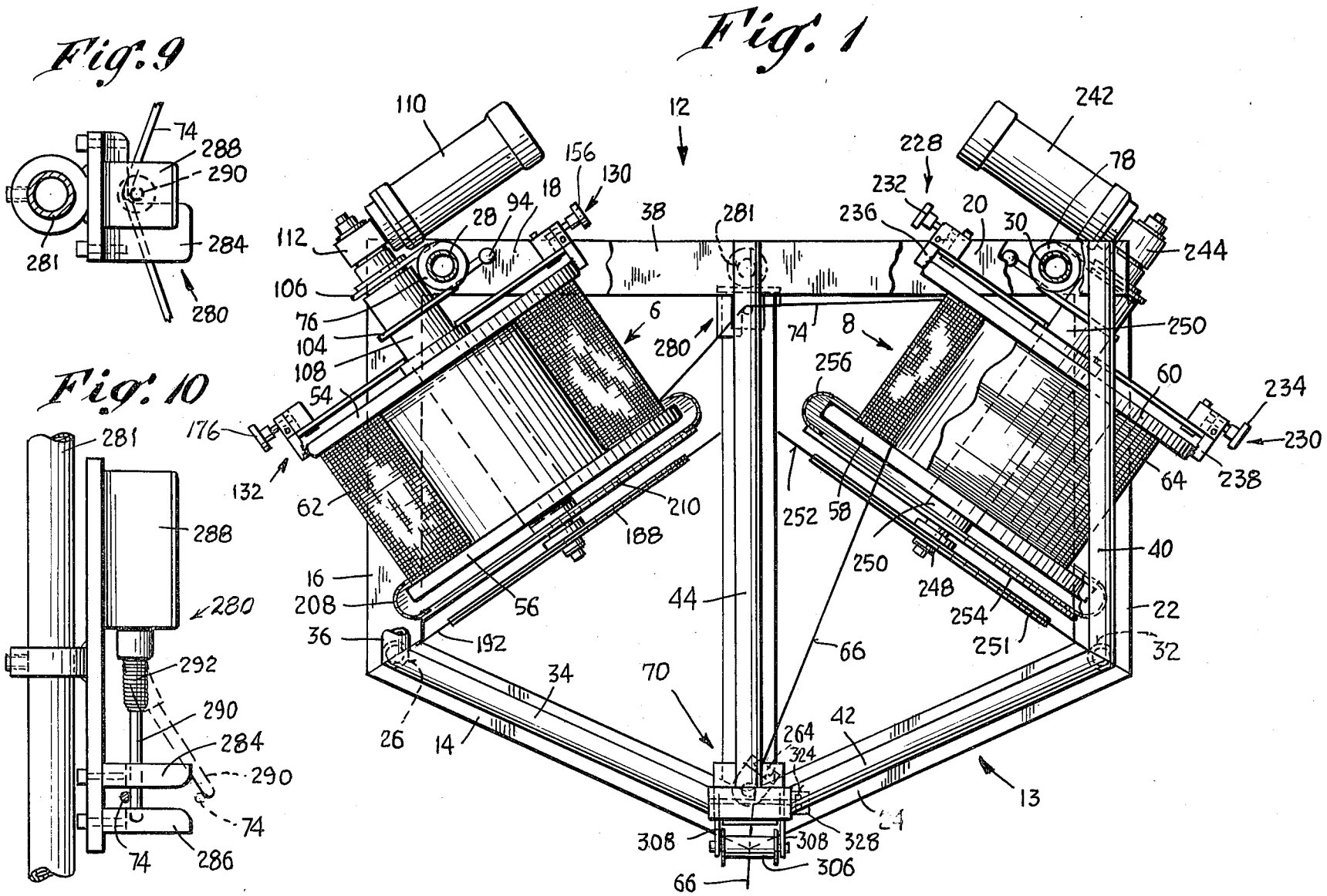
FIG. 1 is a top plan view of the improved wire take-off device of the present invention, particularly showing two wire-filled spools carried thereon, the spools being disposed in the operative positions which they would normally occupy during pay-out of wire, and further illustrating freely-mounted wheels and tension brush devices associated with each spool.
FIG. 9 is a bottom plan view of a trip mechanism which is operated by the wire strand as pay-off from one spool is completed, and as pay-off from the second spool is about to begin.
FIG. 10 is a side elevational view of the trip mechanism of FIG. 9.
Figures 2, 6, 7, 8:
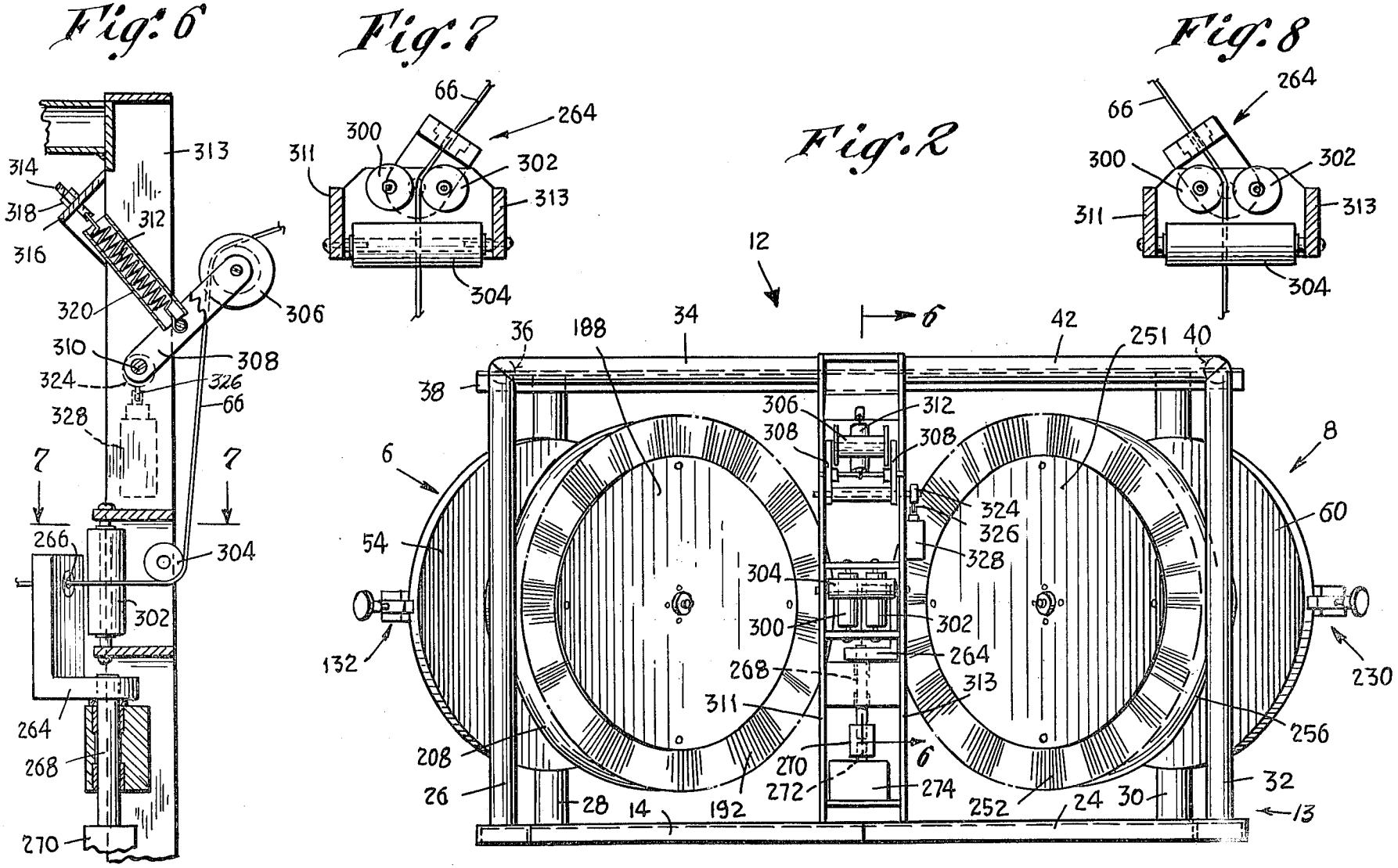
FIG. 2 is a front elevational view of the apparatus of FIG. 1.
FIG. 6 is a side elevational view of a wire guide for the strand as it leaves either of the spools, and a sensor arrangement that monitors the tension in the strand and which can institute a shut-down of the equipment in the event that the strand inadvertently breaks.
FIG. 7 is a view taken on the line 7—7, showing the wire guide occupying a first position wherein it faces one of the spools.
FIG. 8 is a view like FIG. 7 except showing the wire guide having shifted to a second position wherein it faces the other of said spools.
Figures 3, 4, 5:
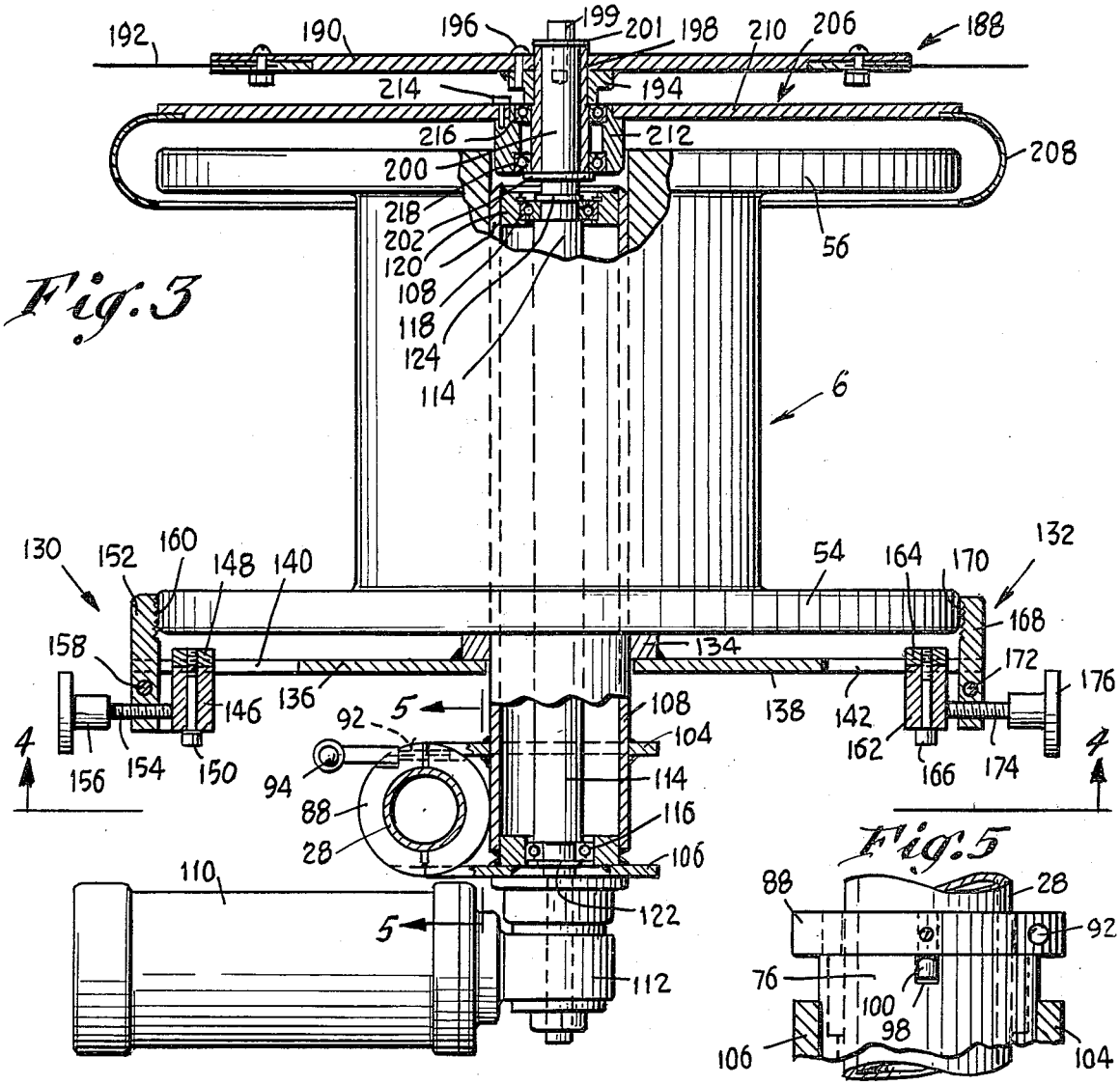
FIG. 3 is a horizontal section through one of the upstanding supports of the machine frame, and particularly illustrating details of the spool mounting arrangement.
FIG. 4 is a vertical section taken on the line 4—4 of FIG. 3.
FIG. 5 is a view taken on the line 5—5 of FIG. 3.

Referring first to FIGS. 1–3, there is shown a wire de-reeling apparatus for enabling high-speed, continuous pay-out of wire from two wire-filled spools 6 and 8 in succession, the apparatus being generally designated by the numeral 12 and having a metal framework 13 which includes base members 14, 16, 18, 20, 22 and 24. Preferably, all of the members are constituted of flat bar stock, welded together to form the configuration shown. In addition, four upright corners supports 26, 28, 30 and 32 are provided, which support an upper framework comprising rails 34, 36, 38, 40, 42 and 44.

Referring again particularly to FIG. 1, two of the corner supports 28, 30 constitute slides on which the two spools 6 and 8 are carried. The spools have generally circular end flanges 54, 56 and 58, 60, and are shown as being filled with coiled wire 62, 64, with a strand 66 extending from the spool 8 to a guide area generally designated 70. The present apparatus is especially adapted to be used with two spools carrying a single, continuous (un-spliced) length of wire, such that pay-out of wire can be effected from the first spool 8 until it is depleted, with pay-out from the second spool 6 commencing automatically thereafter, without halting the movement of the strand 66, or otherwise shutting down the equipment. In FIG. 1, there is shown a strand 74 extending from the innermost layer of the windings 64 carried on spool 8 to the outer layer of windings 62 on the spool 6.

In accomplishing the support of the spools 6, 8, and in accordance with the invention there is carried on the slides 28, 30 a pair of vertically-movable sliders or swivel carriers 76, 78, respectively. The sliders 76, 78 permit positioning of the spools 6, 8, such that their axes lie in substantially a single plane, and diverge generally toward the guide area 70 as in FIG. 1. While it is preferable that the spool axes are co-planar, it can be readily understood that in actual use, slight misalignments may inadvertently occur wherein the axes of the spools 6, 8 would not strictly converge to a single point at the guide area 70.

FIG. 3 shows the spool 6 mounted on the slider 76. The slider 76 is in the form of a tubular sleeve having annular slide bearings 82, 84 (FIG. 4). A generally cylindrical stop collar 86 is welded or otherwise secured to the slide 28. In addition, a second collar 88 is provided, constituting a locking collar for holding the slider 76 in a predetermined, fixed, angular position with respect to the slide 28. In accomplishing this, the collar 88 is slitted and includes an adjustment screw 92 which is connected with a hand crank 94 such that the collar 88 can be locked in place. Referring to FIG. 5, it can be seen that the slider 76 has a small notch 98, which is adapted to receive a corresponding tooth in the form of a pin 100 on the locking collar 88. With the tooth 100 occupying the notch 98, and the screw 92 tightened, the slider 76 will be held against rotation on the slide 28.

Referring again to FIG. 3, there is welded to the slider 76 a pair of spaced support plates 104, 106, which in turn carry a tubular spool support member 108. In addition, mounted on the plate 106 is an electric motor indicated by the numeral 110, and a gear-reduction box 112. Output power from the gear box 112 is applied to a drive shaft or drive spindle 114 which is concentric with the tubular spool support member 108 and disposed inside of the same. A bearing 116 supports the shaft 114. Disposed at the opposite end of the support member 108 is an additional bearing 118, which is fitted into a suitable collar 120. Small snap retainer rings 122, 124 are received in corresponding grooves in the shaft 114 respectively, to hold the latter in place. The support member is adapted to be received in the bore of the spool, as shown.

Referring again to FIG. 3, the spool flange 54 is rigidly clamped between two jaws generally designated 130 and 132. The support member 108 further has an annular collar 134 which is preferably welded thereon, and a pair of radially extending flange-support arms 136, 138 are provided, welded to the collar 134. As particularly shown in FIG. 4, arm 136 has a radial slot 140, with the arm 138 having a similar slot 142. Movable in the slot 140 is a two-part, locking slide, the parts being designated by the numerals 146 and 148, held together by means of a cap screw 150. The part 148 is threaded, such that by loosening the screw 150, the parts 146, 148 can be adjustably positioned in the slot 140 and thereafter the screw 150 tightened. Carried by the part 146 is a pivotal jaw 152 having a screw 154 and manually engageable knob 156. The jaw 152 can pivot about a pin 158. In addition, the jaw 152 has a serrated flange-engagement face 160 which is adapted to grip the edge portion of the spool flange 54.

In a similar manner, the clamp 132 grips a diametrically opposed portion of the flange 54. In accomplishing this, there is provided a two-part slide, the parts being designated by the numerals 162, 164, with a cap screw 166 provided to draw the parts 162, 164 together in a predetermined, adjusted position in the slot 142. A pivot jaw 168 having a serrated flange-engagement face 170 is also provided, the jaw pivoting about a pin 172, with tightening of the jaw being accomplished by means of an adjustment screw 174 and knob 176. With such an arrangement, diametrically opposed portions of the flange 54 can be tightly clamped between the jaws 152, 168, and the spool 6 held in a predetermined, fixed, angular position with respect to the remaining parts of the frame, and with respect to the guide area 70.

In accordance with the present invention there is provided a novel arrangement involving the combination of a freely-mounted take-off wheel and power-driven, variable speed tension brush for facilitating high-speed, uninterrupted pay-out of wire off the free end of a spool, without looseness or kinking, and with minimal possibility of inadvertent breakage of the strand. As particularly shown in FIG. 3, the driven shaft 114 directly carries the tension brush 188, the brush having a body 190 and a plurality of closely-spaced, radially-extending, resilient bristles or tines 192. The body 190 is secured to a bushing or hub 194 by means of a suitable fastener 196, the hub 194 in turn being carried by a sleeve 198 which is disposed on the end 200 of the shaft 114. The sleeve 198 butts against a split washer 202 that is carried in a groove in the shaft 114. The sleeve is releasably secured on the shaft 114 by a capscrew 199 and washer 201, such that the hub 194 can be removed when it is desired to remove and replace the spool 6.

The freely-mounted take-off wheel is designated 206, having a peripheral flange 208 of generally circular cross section and being carried on a generally disk-like body 210. The latter is secured to a central bushing 212 by means of a fastener 214, the bushing 212 in turn being carried on a pair of ball bearings 216, 218 which are pressed onto the sleeve 198. Also, the bearing 218 engages the washer 202 as illustrated in FIG. 3. As shown, the wheel is generally coaxial with the spool, and can be released from the member 108 when it is desired to remove and replace the spool 6.

With such an arrangement, it can be seen that drive power from the motor 110 can be applied, through the gear box 112, to the shaft 114, this in turn driving the tension brush 188 at different desired speeds, depending on the take-off speed of the wire being de-reeled. A more complete discussion of the nature of the variation of speed will follow.

Also, by the above arrangement it be seen that the wheel 206 is substantially freely-mounted with respect to the driven shaft 114, and its movement can be largely independent of the movement of the brush 188. As wire is payed out off the free end of the spool, the strand directly engages the peripheral flange 208 of the wheel 206, tending to impart a turning movement thereto. The flange 208 prevents direct contact of the unreeling strand with the flange 56, thereby eliminating any tendency for the latter to become worn, and also minimizing any abrasion to the strand being de-reeled. In general, the tension brush 188 is rotatably driven such that the circumferential speed of the bristles is slightly less that the lateral speed of the strand as it travels about the periphery of the flange 56. The brush speed (tangential) is typically from 10% to 25% less than the strand's tangential speed. With this arrangement, the bristles 192 impart only a relatively small drag force to the strand. The drag effect imparted by the bristles is sufficient to prevent undesirable free unraveling of the strands, thus reducing the tendency for the wire to become excessively loose, kinked, broken, etc. However, the drag is not so great as to cause undue strain on the strand, possibly leading to its breakage.

Referring again to FIG. 1, it can be seen that the spool 8 is equipped with a freely-mounted wheel and motor-driven tension brush arrangement similar to those described above in connection with the spool 6. In particular, the components that are associated with the spool 8 include a pair of clamps 228, 230 that are adapted to engage diametrically opposed portions of the spool flange 60, the clamps including manually engageable knobs 232 and 234, respectively, by which the jaws 236 and 238 can be made to clamp the flange. A tubular spool support member 250 is provided, and is received in the bore of the spool 8, to support the same. A drive motor 242 imparts turning movement, through a gear box 244, to a shaft which extends through the support member 250. The shaft carries a central hub 248 on which there is mounted the brush body 251 having radially extending bristles 252. The freely-mounted wheel is designated by the numeral 254, and has a peripheral flange 256 of generally circular cross section which extends over the spool flange 58.

The spools 6 and 8 are mounted on the frame 13 in such a manner that their axes converge generally toward the guide area 70. In accordance with the present invention, swiveling guide means in the form of a wire guide are provided for directing the strand 66 after it leaves the spool 8, the guide means being particularly illustrated in FIGS. 6 and 7 and comprising an angle plate or swivel plate 264 having a guide opening 266, the axis of which is adapted to be substantially aligned with the strand 66 as pay-out from the spool 8 is occurring. The guide plate 264 is capable of swiveling about an axis which is askew to the axes of the two spools from a first position shown in FIGS. 1 and 7, wherein the aperture 266 is aligned with and faces the axis of the spool 8, to a second position shown in FIG. 8, wherein the aperture 266 is substantially aligned with and faces the axis of the spool 6. In accomplishing such swiveling movement, the plate 264 is mounted on a shaft 268 which is received in a coupling 270, the latter in turn being connected to the shaft 272 of a solenoid operator 274, the latter being shown in FIG. 2. The solenoid operator 274 effects swiveling of the guide plate 264 at the time that the one spool 8 becomes depleted, and pay-out commences from the second spool 6.

Figure 14:
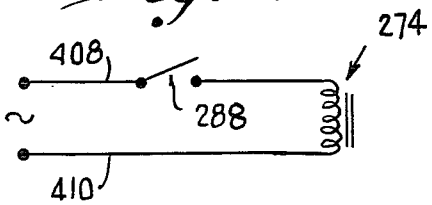
FIG. 14 is a schematic circuit diagram of the control which is activated by the trip mechanism, and which operates to shift the wire guide between its first and second positions at the time that one spool becomes depleted, and de-reeling from the other spool begins.

Shifting of the guide plate 264 at the proper instant is automatically accomplished by means of a trip mechanism 280 particularly shown in FIGS. 9 and 10. The mechanism is carried on an upright support 281 which is located at the rear of the frame 13. Small protruding horizontal plates or members 284, 286 are provided, and adapted to confine that portion of the strand 74 which extends between the two spools. In FIG. 10, the strand 74 is shown in cross section. The trip mechanism 280 further comprises a switch 288 having a toggle member 290 which is biased in a generally vertical position by means of a spring 292. The switch 288 is so arranged that it remains electrically open-circuited when the toggle member 290 is in a vertical position and closes when the member 290 is shifted from a vertical position, as would occur were the strand 74 pulled outwardly (to the right) as in FIG. 10. Such pulling would occur in the event that pay-off were being effected first from the spool 8 and just at the instant that it had become fully depleted. Thus, the movement of the strand 74 shifts the toggle member 290 thereby tripping the switch 288. This in turn effects a virtually instantaneous swiveling of the guide plate 264 from the position shown in FIG. 7 wherein the plate is aligned with the axis of the spool 8, to the position shown in FIG. 8 wherein the aperture 266 is aligned with the axis of the second spool 6. The electrical connections between the switch 288 and the solenoid operator 274 for accomplishing the automatic transfer from one spool to the other are shown in FIG. 14.

Referring again to FIG. 2, also located at the guide area 70 are supplementary wire guide means in the form of a pair of substantially parallel, spaced rollers 300, 302, and an additional, third substantially horizontal roller 304. After the strand passes through the aperture 266, it runs between the rollers 300, 302, and also engages the horizontal roller 304. The routing of the strand 66 is particularly illustrated in FIG. 6.

In accordance with the present invention, means are provided for sensing the tension in the strand 66 and for disabling the motors 110, 242 in the event that the tension is lost, due to inadvertent breakage of the strand. After the strand leaves the roller 304, it extends upwardly and passes over an additional roller or pulley 306, which is carried on a swivel arm 308. The arm 308 is pivoted on a pin 310 which is carried on parallel supports 311 and 313. A spring 312 extends from the center of the arm 308, and is connected to an adjustment screw 314 which is threaded into an angularly disposed plate 316, the screw having a locking nut 318. A protective plastic sleeve 320 covers the spring, in order to eliminate the possibility of the strand 66 becoming entangled in the coils thereof. With the locking nut 318 loosened, the screw 314 can be adjusted in order to provide proper tension in the spring 312.

Referring again to FIG. 6, there is provided on the arm 308 an eccentric cam 324 which is adapted to be engaged by a cam follower 326 that in turn is arranged to operate an additional switch 328. The switch is connected in such a way as to control power to the electric motors 110, 242, and operates to shut down the motors in the event that the arm 308 swings in a counterclockwise direction in FIG. 6, as would occur were the strand 66 to suffer inadvertent breakage. In the event that such breakage does occur, the above arrangement effectively halts the pay-out of wire, so as to eliminate the possibility of the brushes 188, 251 continuing to rotate; such rotation would result in uncontrolled unraveling of additional turns of wire from either one of the spools 6 or 8, leading to excessive looseness, kinking, etc.

Figure 12:
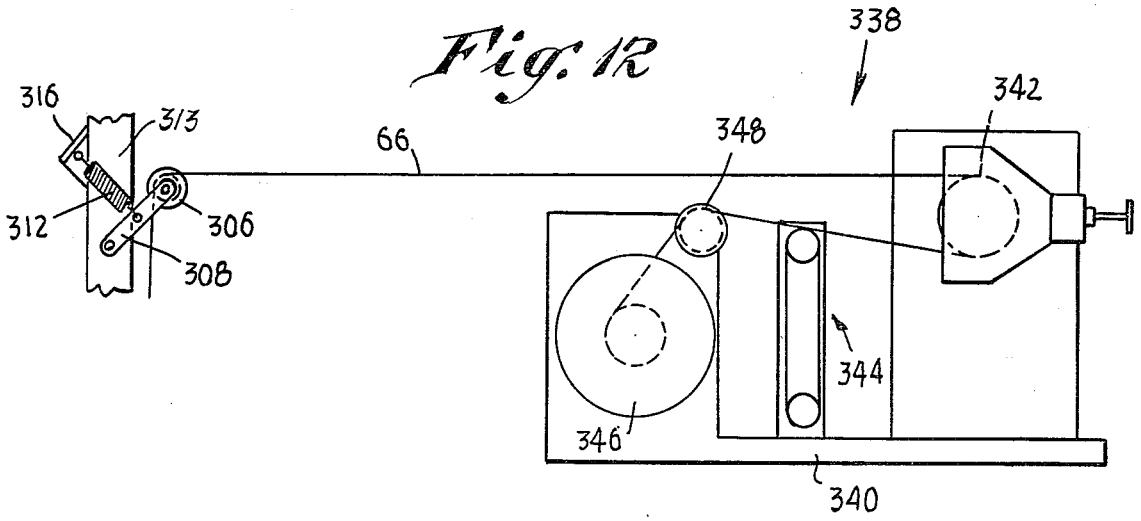
FIG. 12 is a side elevational view of a take-up mechanism having a power-driven capstan, the mechanism being suitable for use with the pay-off device of FIG. 1.

FIG. 12 illustrates a suitable take-up mechanism or apparatus 338 which could be employed with the pay-out device of the present invention. The take-up mechanism has a base 340, on which there is mounted a power-driven take-up capstan 342. As can be readily seen, the strand 66 passes over this capstan 342, and thereafter is engaged by a traverse mechanism 344 which reciprocates the strand back and forth so as to form layers on the take-up reel 346. In addition, an idler wheel 348 is provided, intermediate the traverse mechanism 344 and the take-up reel 346. Preferably, the reel 346 is driven through a slip clutch (not shown) and at a rate which is sufficient to maintain adequate tension in the strand 66 between the driven capstan 342 and the reel 346.

Figure 13:
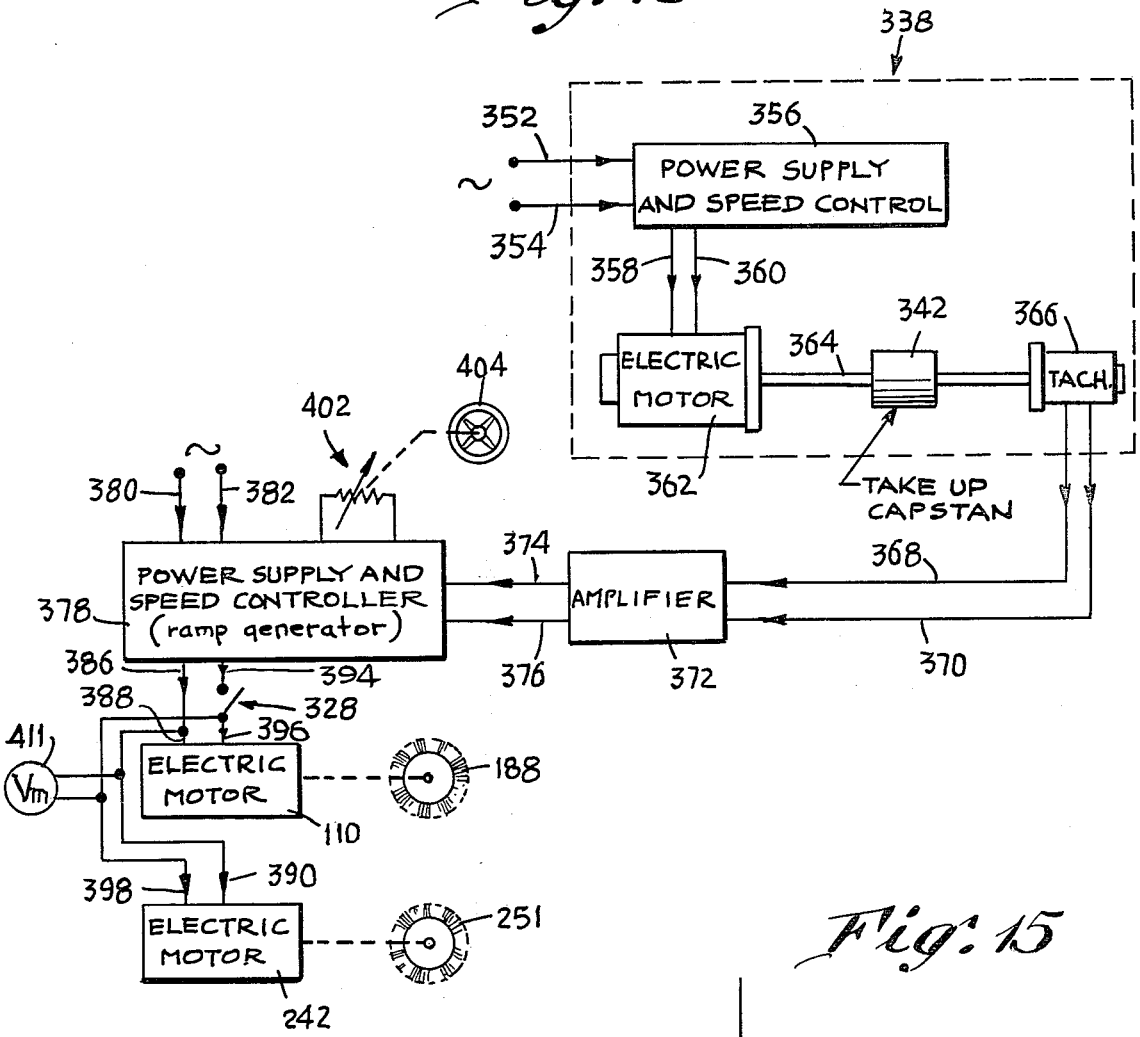
FIG. 13 is a schematic wiring diagram of suitable control circuitry employed with the electric motors that operate the tension brushes, as well as the electric motor which drives a take-up capstan in the take-up mechanism of FIG. 12.

Referring now to FIG. 13, there is shown a block diagram of a control system which could be employed with the de-reeling apparatus of FIG. 1 and the take-up apparatus of FIG. 12. The take-up apparatus 338 has input terminals 352, 354 by which a power supply and speed controller unit 356 is energized. Output leads 358, 360 extend to an electric motor 362 having an output shaft 364 which is connected to drive the take-up capstan 342. In addition, coupled to the shaft 364 is a tachometer 366 which provides an output voltage on lines 368 and 370 which is proportional to the speed of the capstan 342. This voltage is in turn applied to an amplifier 372, and the output thereof, on lines 374 and 376, is applied to the input of a second power supply and second controller 378. Electrical energy is supplied to the terminals 380, 382, and the output of the controller 378 extends via a line 386 to one terminal 388 of the electric motor 110, and to one terminal 390 of the electric motor 242. The other terminal 394 of the controller 378 is connected to the switch 328, this in turn extending to the other input terminals 396, 398 of the motors 110, 242, respectively. The motor 110 is arranged to drive tension brush 188, with the motor 242 being connected to drive the brush 251.

Figure 15:
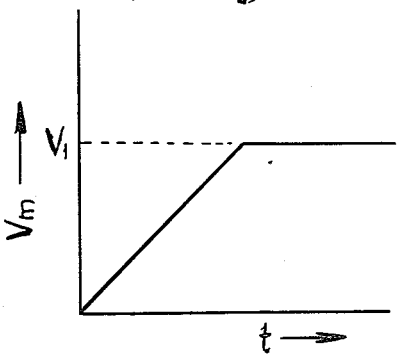
FIG. 15 is a graph illustrating the nature of the voltage that is applied to the electric motors which drive the tension brushes, and which results in their gradual acceleration during start up of the equipment.

FIG. 15 indicates the nature of the voltage which is applied to the input terminals 388, 396 and 390, 398. A meter 400 which is connected across the terminals would provide readings similar to that of FIG. 15, if the voltage were to be plotted against time. Suitable control means generally designated 402 are provided, for varying the steady-state value of Vm, labeled $V_1$, so as to set the steady-state speed of the brushes 188, 251 at the desired rate. Operation of the control 402 is effected by manually rotating a hand wheel 404. As pointed out above, the speed of brushes 188, 251 is set so as to lag the peripheral speed of the strand around the spool flange 56 or 58 by a slight amount, typically but not necessarily 10%, or more.

FIG. 14 is a schematic diagram of the circuit involving the trip switch 288 and solenoid 274. Power is applied to the input terminals 408, 410, with the switch 288 being open. Closing of the switch 288 effects energization of the solenoid 274, which in turn shifts the guide plate 264 from its first position facing the axis of the spool 8 as in FIG. 7, to its second position as illustrated in FIG. 8, facing the axis of the spool 6.

It is assumed that the operator 274 is of the "latching" type, or "holding" type wherein a momentary closing of the switch 288 effects shifting of the operator and wherein the operator remains in its shifted position after the switch 288 is opened.

Figure 11:
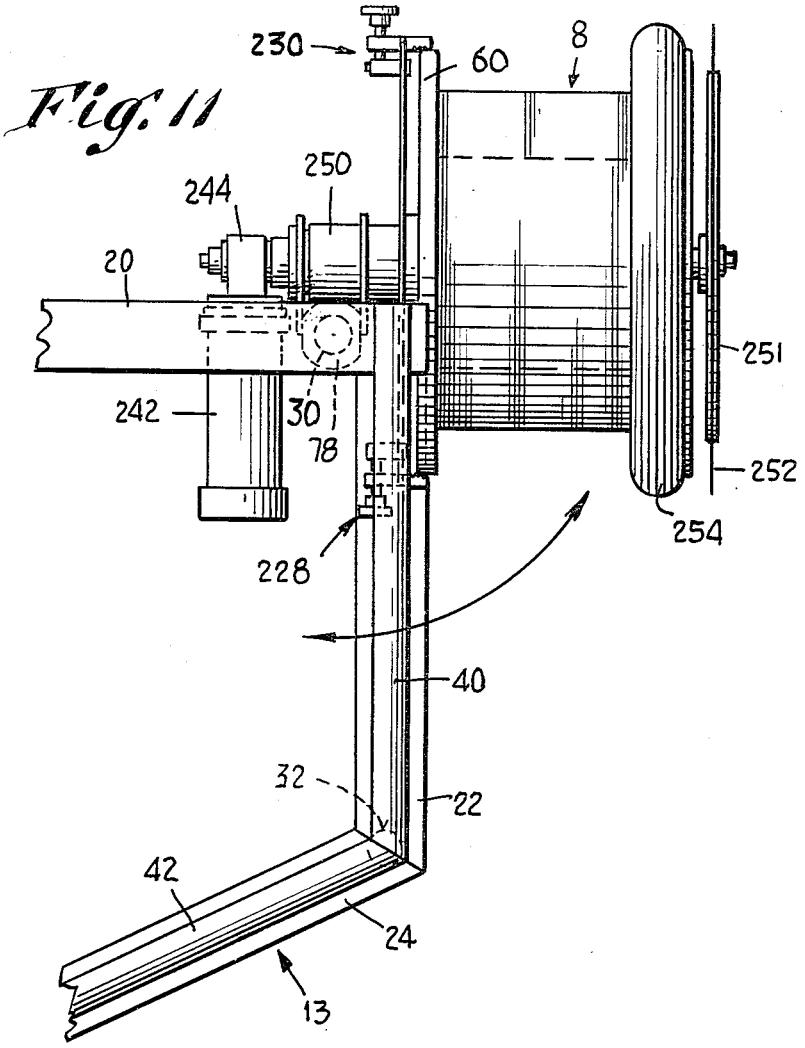
FIG. 11 is a fragmentary top plan view of the apparatus of FIG. 1, except showing one of the spools having been swung to a position wherein it is completely accessible from outside of the frame of the take-off device, so as to facilitate installation or removal of the spool.

The operation of the improved take-off or de-reeling apparatus can now be readily understood by referring to FIGS. 1, 2, 12, 13, 14 and 15. In order to facilitate loading of the spools 6, 8 when filled, by the present invention the tubular support members 108 and 250 can be released by loosening the locking collar 88 on the slide 28 and the similar locking collar on the slide 30. The members 108 and 250 can then be swung to positions wherein they lie outside of the frame 13. FIG. 11 illustrates the position of the support member 250 and spool 8 when they are swung outwardly in this manner.

For purposes of explanation, it will be assumed that pay-off from the spool 8 will occur first, followed by pay-off from the second spool 6. After the spools are placed on the respective tubular members, the clamps 130, 132 and 228, 230 are adjustably positioned so as to engage the respective spool flanges 54 and 60, and the knobs 156, 176 and 232, 234 tightened. After the tension brushes 188, 251 and freely-rotating wheels 206, 254 are installed, the support members 250, 108 are then swung back to the positions illustrated in FIG. 1, such that the axes of the spools 6, 8 generally face toward the guide area 70. The locking collar 88 and the similar locking collar for the member 250 are then tightened. FIG. 1 shows the strand 66 extending from the spool 8, and threaded through the hole 266 in the guide plate 264. The strand 74 which joins the remaining turns of wire on each spool is positioned between the supports 284, 286 and in the back of the toggle member 290, as shown in FIG. 10. The strand 66 passes between the rollers 300, 302, under the roller 304, and over the pulley 306. In FIG. 12, the strand 66 then extends around the power-driven take-up capstan 342, past the traverse mechanism 344 and the idler wheel 348, to the driven take-up reel 346.

In FIG. 13, upon energization of the electric motor 362 in the take-up mechanism 338, the drive capstan 342 begins to pull the strand 66, resulting in a lateral movement of the arm 308 in a clockwise direction which has the effect of closing the switch 328, which in turn results in the application of a gradually increasing voltage to the motors 110 and 242. The speed controller 378 receives an input signal from the tachometer 366 through the amplifier 372, which provides an indication of the speed of the capstan 342. The controller 378 in turn generates a ramp voltage as illustrated in FIG. 15, such that the electric motor 110 and tension brush 188, as well as the motor 242 and tension brush 251 begin to accelerate, with the rate of the turning of the brushes 188 and 251 being slightly less than the rate at which the strand 66 travels about the periphery of either of the corresponding spool flanges. When the capstan 342 reaches its normal running speed as set by the operator, the brushes 188 and 251 will be turnably driven at the proper speed so as to impart a small drag force on the strand 66, such drag force being insufficient to cause breakage of the strand. Minor variation in the steady-state speed of the brushes 188 and 251 can be effected by adjustment of the control 402, with the wheel 404, as shown in FIG. 13.

As the spool 8 becomes depleted, continuing movement of the strand 66 will cause the strand 74 to actuate the toggle member 290, FIG. 10, which will close switch 288 and result in energization of the solenoid 274 to shift the guide plate 264 from the position shown in FIGS. 1 and 7 to that illustrated in FIG. 8. The guide plate 264 now faces the axis of the second spool 6, and pay-off from the spool 6 commences until the spool is fully depleted. At such time, the tension of the strand on the pulley 306 will cease, enabling it to swing upwardly (counterclockwise about pivot 310) in FIG. 7, this in turn opening the switch 328 and shutting down the electric motors 110 and 242. The emptied spools 6 and 8 can then be swung outwardly with respect to the frame 13 and removed from the respective support members 250, 108. The take-off apparatus 12 is then ready to accept a second pair of loaded spools, for processing.

The above arrangement wherein a continuous pay-out is made possible by means of unique, swiveling wire guide 264 has been found to be very effective in handling large quantities of wire carried on two spools. With the above apparatus, pay-out from both spools in succession can be accomplished, all without the need for shutting down the equipment or slowing down the take-off speed, and with little or no possibility of breakage of the wire strand. In cases where it is necessary to have a continuous length of wire of substantial length, the present arrangement has been found to solve many of the difficulties previously encountered as far as achieving high-speed operation with little or no damage from breakage, etc., resulting in minimal down-time and reduced overall handling cost.

In the event that a malfunction does occur, resulting in breakage of the strand 66, the arm 308 (FIG. 7) will swing upwardly (counterclockwise about pivot 310) and actuate the switch 328, so that the electric motors 110 and 242 will be shut down. This eliminates the possibility of multiple turns of wire being unraveled by either of the tension brushes, after inadvertent breakage of a strand has occurred.

By virtue of the unique arrangement of the sliders 76,78, the support members 108, 250 for the spools can be conveniently swung to positions outside the confines of the frame 13, as illustrated in FIG. 11, this arrangement greatly facilitating the loading and unloading of spools. Quite often, such spools weigh hundreds of pounds when filled with wire. Accordingly, it is considered extremely important that the spool-handling equipment be able to accommodate such spools, without complications arising from space limitations, the necessity for the operator to assume awkward positions during loading-unloading, etc. The equipment described above has been found to be exceptionally well-adapted for use with these large and heavy, wire-filled spools.

Another feature of the invention resides in the mounting for the wheel 206 by which a slight starting and turning impetus is given to it at the time that power is applied to the shaft 114. It will be seen in FIG. 3 that the inner races for the bearings 216, 218 are carried by the driven shaft 114; this imparts a slight turning torque to the wheel 206 due to the inherent drag that is had in the bearings. Thus, an advantageous turning tendency is experienced by the wheel 206 which is in the same direction as the turning of the tension brush 188, thereby providing an important assist during the start-up of the wire pay-off, and during normal running thereof.

It will be understood that the present improved, wire-handling device as set forth above is both simple in construction, and especially reliable over extended periods. The unit is thus seen to represent a distinct advance and improvement in the technology of wire-handling equipment.

Variations and modifications are possible without departing from the spirit of the invention.

Each and every one of the appended claims defines a distinct aspect of the invention separate from the others, and accordingly, each claim is to be treated in this manner when the prior art devices are examined in any determination of novelty or validity.

I claim:

1. A take-off device for use in de-reeling wire from a spool without excessive looseness or kinking, comprising in combination:

(a) a support adapted to fixedly mount the spool with one spool-end free, (b) a freely-mounted take-off wheel located at the free end of the spool, said wheel being generally coaxial with the spool and extending radially at least to the rim portion of said one spool end to be engaged and rotated by wire which is unreeled, in a predetermined direction, from the spool past said end, (c) means providing a rotatable hub at said free end of the spool, and adjacent the axis of said wheel, (d) a plurality of substantially radially disposed flexible and slender, spoke-like wire-restraining tines fixedly supported at their adjoining inner ends on said hub, said tines extending past the periphery of the wheel, the outer end portions of said tines yielding to and being shifted peripherally by the unreeling wire, said wire being thereby restrained from wholly free travel around the periphery of the spool end, and being prevented from freely unwinding around the spool end and kinking during slow wire take-off speeds or halting of the wire, and (e) powered means connected with said hub for rotatably driving the same in said predetermined direction, and at a rate which is less than the speed at which the wire traverses the periphery of said one spool end, during relatively faster wire take-off speeds.

2. The invention as defined in claim 1, wherein:

(a) said powered means comprises a variable speed electric motor connected to drive said hub, and having input terminals adapted to be energized from a source of voltage, (b) the output speed of said motor varying with the characteristics of the input voltage applied to said terminals, and (c) automatic means for altering the nature of said input voltage so as to provide a variable speed drive of the said hub and tines, in order that the rotation of the hub can be adjusted to accommodate different wire take-off speeds.

3. The invention as defined in claim 1, wherein:

(a) said powered means comprises a variable speed d.c. motor connected to drive said hub, and having input terminals adapted to be energized from a source of voltage, (b) the output speed of said motor varying with the magnitude of the input voltage applied to said terminals, and (c) automatic means for increasing or decreasing the magnitude of said input voltage so as to provide a variable speed drive of the said hub and tines, in order that the rotation of the hub can be adjusted to accommodate different wire take-off speeds.

4. The invention as defined in claim 1, wherein:

(a) said powered means comprises a variable speed electric motor connected to drive said hub, and having input terminals adapted to be energized from a source of voltage, (b) the output speed of said motor varying with the characteristics of the input voltage applied to said input terminals, and (c) manually operable means for altering the nature of said input voltage so as to provide a variable speed drive of the said hub and tines, in order that the rotation of the hub can be adjusted to accommodate different wire take-off speeds.

5. The invention as defined in claim 3, wherein:

(a) said automatic means comprises a voltage ramp generator, to apply a gradually increasing voltage to the motor over a predetermined time interval, thereby resulting in a general acceleration of the motor speed after initial energization thereof.

6. The invention as defined in claim 1, and further including:

(a) a power driven, take-up reel, to receive a strand of wire from said spool, (b) an electric switch connected to said powered means, to control the same, (c) means for sensing the tension in said strand, and for actuating the switch in the event that the tension decreases suddenly due to inadvertent breakage of the strand, (d) said switch being arranged to render the powered means inoperative when the switch is actuated.

7. The invention as defined in claim 6, wherein:

(a) said tension-sensing means comprises a pulley adapted to be engaged by the strand, (b) spring means tending to bias said pulley laterally in a direction against the tension of said strand, (c) said pulley being linked to said switch such that lateral movement of the pulley, as occasioned by the action of the spring means in the event that the strand breaks, actuates the said switch and renders inoperative the said powered means.

8. The invention as defined in claim 1, wherein:

(a) said spool support comprises a metal framework having an upstanding slide, (b) a swivel carrier adjustably movable on said slide, (c) a tubular spool support member carried by said slide and adapted to be received in the bore of the spool so as to support the same, (d) locking means on said swivel carrier, enabling the latter to be adjustably held in different, fixed angular positions with respect to the upstanding slide to thereby enable the spool support member to be swung to a first position extending generally away from said framework, permitting quick access to the member for loading full spools thereon and for removing emptied spools therefrom, and a second position extending generally within said framework, permitting precise alignment of the axis of the spool to a desired, predetermined position.

9. The invention as defined in claim 1, wherein:

(a) said spool support comprises a metal framework having an upstanding slide, (b) a swivel carrier adjustably movable on said slide, (c) a tubular support member carried by said slide, adapted to be received in the bore of the spool so as to support the same, (d) said powered means comprising a drive spindle extending through the support member and connected to said hub so as to impart turning movement to the latter, and (e) an electric motor connected with said drive spindle so as to power the same.

10. The invention as defined in claim 9, wherein:

(a) said freely-mounted take-off wheel is carried by said drive spindle, and (b) a bearing disposed between said wheel and spindle to enable relative movement of the two parts.

11. The invention as defined in claim 10, wherein:

(a) said hub has releasable means enabling it to be removed from the spindle when it is desired to remove or replace the spool.

12. The invention as defined in claim 10, wherein:

(a) said wheel is releasably carried on the spindle, to enable it to be removed from the spindle, when it is desired to remove or replace the spool.

13. An apparatus for de-reeling wire from multiple wire-carrying spools in succession and without interruption, comprising in combination:

(a) a pair of spools, (b) means for supporting the spools with one end of each spool being free, the axis of each spool generally converging toward a guide area, (c) a wire guide disposed at said guide area, (d) means mounting said guide for swiveling movement about an axis askew with respect to those of the two spools, such that the guide can swing between a first position facing the free end of one of the spools, and a second position facing the free end of the other of said spools, as one spool becomes depleted and de-reeling from the other spool commences, and (e) electrically powered means including a switch activated by wire leaving the depleted spool, for effecting swiveling movement of said wire guide between said first position and said second position.

14. The invention as defined in claim 13, wherein:

(a) said wire guide comprises a swivel plate, (b) said swivel plate having an aperture through which the wire being de-reeled can pass.

15. An apparatus for de-reeling wire from multiple wire-carrying spools in succession and without interruption, comprising in combination:

(a) a pair of spools, (b) means for supporting the spools with one end of each spool being free, the axis of each spool generally converging toward a guide area, (c) a wire guide disposed at said guide area, (d) means mounting said guide for swiveling movement about an axis askew with respect to those of the two spools, such that the guide can swing between a first position facing the free end of one of the spools, and a second position facing the free end of the other of said spools, as one spool becomes depleted and de-reeling from the other spool commences, and (e) powered means for effecting swiveling movement of said wire guide between said first position and said second position.

16. The invention as defined in claim 15, and further including:

(a) trip means responsive to de-reeling of the last turn of wire from one of said spools, for activating said powered means in order to effect swiveling of the wire guide between the said first and second positions at the instant that pay-off from the filled spool commences.

17. An apparatus for de-reeling wire from multiple wire-carrying spools in succession and without interruption, comprising in combination:

(a) a pair of spools, (b) means for supporting the spools with one end of each spool being free, the axis of each spool generally converging toward a guide area, (c) a wire guide disposed at said guide area, (d) means mounting said guide for swiveling movement about an axis askew with respect to those of the two spools, such that the guide can swing between a first position facing the free end of one of the spools, and a second position facing the free end of the other of said spools, as one spool becomes depleted and de-reeling from the other spool commences, and (e) a supplemental wire guide disposed downstream from said first mentioned guide, for piloting the wire in directions away from the spools to suitable take-up apparatus.

18. The invention as defined in claim 17, wherein:

(a) said supplemental wire guide comprises a pair of substantially cylindrical rollers having axes substantially parallel to one another, and parallel to the swivel axis of the wire guide.

19. The invention as defined in claim 18, wherein:

(a) said supplemental wire guide further comprises a third substantially cylindrical roller having an axis generally transverse to the axis of the first two rollers.

20. An apparatus for de-reeling wire from multiple wire-carrying spools in succession and without interruption, comprising in combination:

(a) a pair of spools, (b) means for supporting the spools with one end of each spool being free, the axis of each spool generally converging toward a guide area, (c) a wire guide disposed at said guide area, (d) means mounting said guide for swiveling movement about an axis askew with respect to those of the two spools, such that the guide can swing between a first position facing the free end of one of the spools, and a second position facing the free end of the other of said spools, as one spool becomes depleted and de-reeling from the other spool commences, (e) means providing a rotatable hub at the said end of one of the spools, (f) a freely-mounted take-off wheel located at the said free end, (g) a plurality of substantially radially disposed, flexible and slender spoke-like, wire-restraining tines fixedly supported at their adjoining inner ends on said hub, said tines extending past the periphery of the wheel, the outer end portions of said tines yielding to and being shifted peripherally by the unreeling strand of wire, said wire strand being thereby restrained from wholly free travel around the periphery of the one spool end, and being prevented from freely unwinding around the one spool end and kinking during slow wire speeds or halting of the wire, and (h) powered means connected with said hub for rotatably driving the same at a rate which is less than the speed at which the wire strand traverses the periphery of said one spool end, during relatively faster wire take-off speeds.

21. The invention as defined in claim 20, and further including:

(a) means for detecting loss of tension in the wire strand passing through the wire guide, for deactivating the powered means and preventing excessive and continual de-reeling of wire from the one spool in the event that the strand suffers inadvertent breakage.

22. An apparatus for de-reeling wire from multiple wire-carrying spools in succession and without interruption, comprising in combination:

(a) a pair of spools, (b) means for supporting the spools with one end of each spool being free, the axis of each spool generally converging toward a guide area, (c) a wire guide disposed at said guide area, (d) means mounting said guide for swiveling movement about an axis askew with respect to those of the two spools, such that the guide can swing between a first position facing the free end of one of the spools, and a second position facing the free end of the other of said spools, as one spool becomes depleted and de-reeling from the other spool commences, and (e) means for detecting loss of tension in the wire strand passing adjacent the wire guide, for deactivating the powered means and preventing excessive and continual de-reeling of wire from either spool in the event that the strand suffers inadvertent breakage.

23. The invention as defined in claim 22, wherein:

(a) said tension-detecting means comprises a pulley adapted to be engaged by the strand of wire that passes adjacent the wire guide, (b) spring means tending to bias said pulley laterally in a direction against the tension of said strand, (c) a switch cooperable with said pulley and adapted to be activated by said spring means in the event of loss of tension in said strand due to inadvertent breakage of the same.

24. A high-speed wire-transfer apparatus, comprising in combination:

(a) a spool adapted to carry a quantity of wire, (b) a support adapted to fixedly mount the spool with one spool-end free, (c) a wire take-up mechanism to accept a strand of wire being de-reeled from the spool, (d) said take-up mechanism having powered means for advancing the strand along its path of travel, (e) a rotatable take-off wheel located at the free end of the spool, (f) a rotatable, generally circular tension brush disposed at the free end of the spool and having a plurality of substantially radially disposed, flexible and slender, spoke-like wire-restraining tines extending past the periphery of the wheel, (g) powered means for effecting rotation of said tension brush, and (h) control means connected with the powered means for said take-up mechanism and with the powered means for the tension brush, for regulating the rate of rotation of the tension brush as a function of the speed of travel of the strand that is being advanced.

25. The invention as defined in claim 24, wherein:

(a) the rate of rotation of the tension brush is such that the angular velocity of the periphery of the brush is slightly less than the angular speed of the strand past the periphery of the said one spool end.

26. The invention as defined in claim 24, wherein:

(a) said control means is active during start-up of the take-up mechanism and the tension brush, (b) said take-up mechanism accelerating, following start-up, to a predetermined normal running speed, and the tension brush accelerating at the same time, such that the angular velocity of the periphery of the brush slightly lags the angular speed of the strand past the periphery of the said one spool end.

27. A take-off device for use in de-reeling a strand of wire from two spools in succession, comprising in combination:

(a) a metal framework having a pair of spaced, upstanding slides, and a guide area through which the strand of wire being de-reeled can pass, (b) a pair of swivel carriers adjustably movable on said slides, respectively, (c) spool support members carried respectively by said swivel carriers and each having means adapted to engage the respective spools for holding the latter, with one end of each spool free, (d) said swivel carriers enabling each of the spool support members to be swung to a first position permitting quick access to the same in order to facilitate the loading of full spools thereon and the unloading of empty spools therefrom, and a second position wherein the axes of the spools are generally convergent toward the said guide area to permit pay-off to occur first off the free end of the one spool until it becomes depleted, and then off the free end of the other spool, substantially in succession, (e) electric motors carried by the swivel carriers, (f) shafts passing through the spool support members and driven respectively by said motors, and (g) tension brushes on said shafts, for disposition at the free ends of the spools.

28. The invention as defined in claim 27, and further including:

(a) clamping means adapted to engage the periphery of one spool flange of each of the spools so as to hold the spools in fixed positions on the respective support members.

29. A take-off device for use in de-reeling a strand of wire from two spools in succession, comprising in combination:

(a) a metal framework having a pair of spaced, upstanding slides, and a guide area through which the strand of wire being de-reeled can pass, (b) a pair of swivel carriers adjustably movable on said slides, respectively, (c) spool support members carried respectively by said swivel carriers and each having means adapted to engage the respective spools for holding the latter, with one end of each spool free, (d) said swivel carriers enabling each of the spool support members to be swung to a first position permitting quick access to the same in order to facilitate the loading of full spools thereon, and the unloading of empty spools therefrom, and a second position wherein the axes of the spools are generally convergent toward the said guide area, to permit pay-off to occur first off the free end of the one spool until it becomes depleted, and then off the free end of the other spool, substantially in succession, and (e) a pair of positioning collars on said slides, respectively, to enable the swivel carriers to rotate about the axes of the slides, respectively, and thereby permit swinging movement of the spools in directions transverse to the axes of the slides.

30. The invention as defined in claim 29, wherein:

(a) said metal framework has a guide area through which the strand of wire being de-reeled can pass, and (b) a pair of locking collars on said slides, respectively, to enable the swivel carriers to be adjustably held in predetermined, fixed positions, with the axes of the spool generally converging toward the said guide area.

31. The invention as defined in claim 1, and further including:

(a) bearing means for said take-off wheel, connected with said powered means and tending to rotate said wheel in the said predetermined direction.

* * * * *